US011805874B1

(12) United States Patent
Feng et al.

(10) Patent No.: US 11,805,874 B1
(45) Date of Patent: Nov. 7, 2023

(54) CARABINER INTEGRATED WALLET AND IDENTIFICATION HOLDER

(71) Applicant: Touching Design LLC, Katy, TX (US)

(72) Inventors: Haoyu Feng, Katy, TX (US); Dan Xiong, Katy, TX (US); Jinyao Feng, Katy, TX (US)

( * ) Notice: Subject to any disclaimer, the term of this patent is extended or adjusted under 35 U.S.C. 154(b) by 0 days.

(21) Appl. No.: 18/141,440

(22) Filed: Apr. 30, 2023

Related U.S. Application Data

(63) Continuation-in-part of application No. 29/861,730, filed on Dec. 1, 2022, now Pat. No. Des. 991,676.

(51) Int. Cl.
*A45C 11/18* (2006.01)

(52) U.S. Cl.
CPC ..... *A45C 11/182* (2013.01)

(58) Field of Classification Search
CPC ..... A45C 11/18; A45C 2001/065; A45C 2011/186
See application file for complete search history.

(56) References Cited

U.S. PATENT DOCUMENTS

| | | | | |
|---|---|---|---|---|
| 7,540,140 | B1 | 6/2009 | Diaz et al. | |
| 7,614,209 | B1 | 11/2009 | Payne et al. | |
| 8,172,476 | B2 | 5/2012 | Berney | |
| D686,058 | S | 7/2013 | Paik et al. | |
| D698,626 | S | 2/2014 | Ormsbee et al. | |
| D704,594 | S | 5/2014 | Cherin et al. | |
| D784,798 | S | 4/2017 | Logsdon et al. | |
| 9,903,511 | B2 | 2/2018 | Vermillion | |
| D861,327 | S | 10/2019 | Osmanski | |
| D863,101 | S | 10/2019 | Chang | |
| D876,934 | S | 3/2020 | Adelman | |
| D931,085 | S | 9/2021 | Paik et al. | |
| D953,147 | S | 5/2022 | Wildes | |
| D954,538 | S | 6/2022 | Grossman | |
| D954,539 | S | 6/2022 | Grossman | |
| D954,540 | S | 6/2022 | Grossman | |
| D954,541 | S | 6/2022 | Grossman | |
| 2005/0155208 | A1* | 7/2005 | Schneider | A45C 1/06 29/450 |
| 2012/0201599 | A1 | 8/2012 | Reppen | |
| 2014/0020798 | A1* | 1/2014 | Kitchen | A45C 11/182 150/137 |
| 2015/0342314 | A1* | 12/2015 | Christy | A45C 11/182 206/38 |
| 2018/0368544 | A1* | 12/2018 | King | A45C 11/182 |
| 2019/0269213 | A1* | 9/2019 | Deng | A45C 11/182 |
| 2020/0229557 | A1* | 7/2020 | Tran | A45C 1/06 |
| 2020/0237063 | A1* | 7/2020 | Zane | A45C 1/06 |
| 2022/0018384 | A1 | 1/2022 | Adelman | |

* cited by examiner

*Primary Examiner* — Sue A Weaver
(74) *Attorney, Agent, or Firm* — Gallium Law; Wesley Schwie, Esq.; Justin Schwechter

(57) ABSTRACT

The present disclosure includes an apparatus, including a frame having a front surface and a back surface. In some examples, the frame is configured to hold a card at the front surface. According to some examples, the frame is configured to release the card via a force from the back surface. The apparatus may include a slot configured to receive the force from the back surface during the release of the card.

20 Claims, 8 Drawing Sheets

CARABINER INTEGRATED WALLET AND IDENTIFICATION HOLDER

BACKGROUND

Wallets are small cases designed to hold and carry personal items such as cash, credit cards, and identification. They are available in a wide range of materials, styles, and designs to meet different needs and preferences, from classic leather billfolds to minimalist cardholders and high-tech smart wallets. Overall, wallets are a popular accessory for many people, providing a convenient and secure way to carry and organize personal items.

Identification (ID) lanyards are worn around the neck as a means of displaying identification cards or badges. They typically consist of a strap or cord that is attached to a plastic or metal holder for the ID card. The lanyard itself can be made from a variety of materials, including nylon, polyester, or cotton. Identification lanyards are commonly used in a wide range of settings, such as workplaces, schools, and events, to help identify individuals and ensure security. They offer a convenient and hands-free way to carry identification, allowing for quick and easy access when needed. Many organizations also customize their lanyards with logos or branding to promote their brand or enhance their professional image.

SUMMARY

Included in the present disclosure is an apparatus (e.g., see the apparatus 10 as shown in FIG. 1), including a frame (e.g., see the frame 102 as shown in FIG. 1) having a front surface (e.g., see the front surface 104 as shown in FIG. 1) and a back surface (e.g., see the back surface 202 as shown in FIG. 2). In some examples, the frame is configured to hold a card (e.g., see example card 502 as shown in FIG. 5) at the front surface. According to some examples, the frame is configured to release the card via a force (e.g., see the force 702 as shown in FIG. 7) from the back surface. The apparatus may include a slot (e.g., see the slot 302 as shown in FIG. 3) configured to receive the force from the back surface during the release of the card.

Also included in the present disclosure is an apparatus (e.g., see the apparatus 10 as shown in FIG. 1), including a frame (e.g., see the frame 102 as shown in FIG. 1) having a front surface (e.g., see the front surface 104 as shown in FIG. 1) and a back surface (e.g., see the back surface 202 as shown in FIG. 2). In some examples, the frame is configured to hold a card (e.g., see example card 502 as shown in FIG. 5) at the front surface. According to some examples, the frame is configured to release the card via a force (e.g., see the force 702 as shown in FIG. 7) from the back surface. The apparatus may include a band (e.g., the band 106 as shown in FIG. 1), the band covering at least a portion of the frame. In some examples, the band is configured to transfer the force from the back surface to the card during the release of the card. According to some examples, the band is configured to hold an additional card (e.g., see the additional card 602 as shown in FIG. 6) at the back surface.

Also included in the present disclosure is an apparatus (e.g., see the apparatus 10 as shown in FIG. 1), including a frame (e.g., see the frame 102 as shown in FIG. 1) having a front surface (e.g., see the front surface 104 as shown in FIG. 1) and a back surface (e.g., see the back surface 202 as shown in FIG. 2). In some examples, the frame is configured to hold a card (e.g., see example card 502 as shown in FIG. 5) at the front surface. According to some examples, the frame is configured to release the card via a force (e.g., see the force 702 as shown in FIG. 7) from the back surface. The apparatus may include a slot (e.g., see the slot 302 as shown in FIG. 3) configured to receive the force from the back surface during the release of the card. In some examples, the apparatus includes a band (e.g., the band 106 as shown in FIG. 1), the band covering at least a portion of the frame and at least partially covering the slot. According to some examples, the band is configured to transfer the force from the back surface to the card during the release of the card. The band may be configured to hold an additional card (e.g., see the additional card 602 as shown in FIG. 6) at the back surface.

The foregoing, and other features and advantages of the invention, will be apparent from the following, more particular description of the preferred embodiments of the invention, the accompanying drawings, and the claims.

BRIEF DESCRIPTION OF THE DRAWINGS

These and other features, aspects, and advantages are described below with reference to the drawings, which are intended to illustrate, but not to limit, the invention. In the drawings, like characters denote corresponding features consistently throughout similar embodiments.

COMPONENT INDEX

10—Apparatus
102—Frame
104—Front surface
106—Band
108—Front wall
110—Clip
112—Band top surface
202—Back surface
204—Back wall
206—Island
208—Band bottom surface
302—Slot
402—Gap
502—Example card
602—Additional card
702—Force
802—Recessed edge

DETAILED DESCRIPTION

Ejector wallets are a type of wallet designed to protect the owner's money and valuables from theft or loss. They feature a mechanism that allows the user to quickly and easily eject their cards or cash with the push of a button. Ejector wallets come in a variety of designs, ranging from minimalist cardholders to full-size wallets with multiple compartments. They are often made from high-quality materials, such as leather or metal, and offer a stylish and functional way to carry your essentials.

Ejector wallets have become increasingly popular in recent years, thanks in part to their convenience and security features, as well as their sleek and modern design aesthetic. However, ejector wallets, wallets in general, and identification holsters are lanyards, contain several deficiencies that the present disclosure seeks to remedy.

Figure 1:
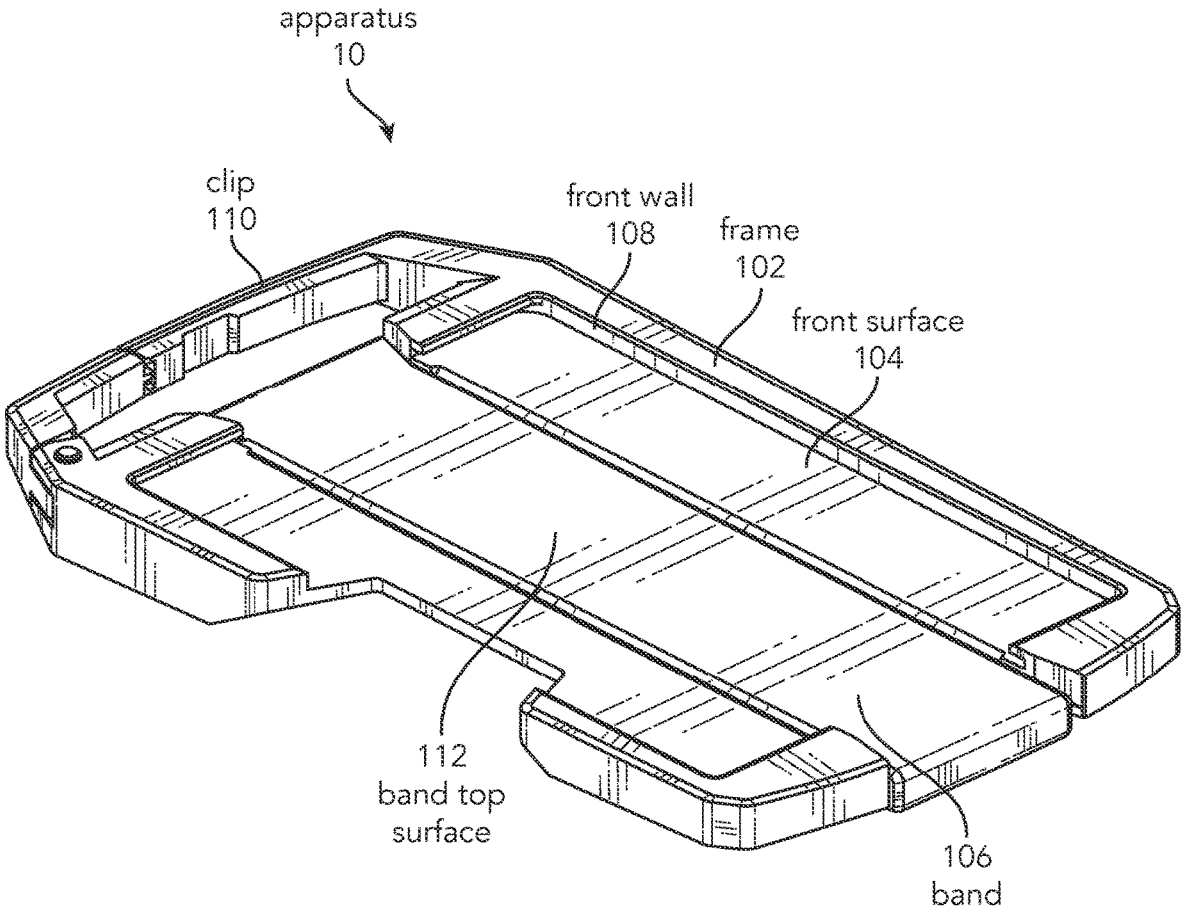
FIG. 1 illustrates a perspective view of an apparatus, according to an example of the present disclosure.

FIG. 1 illustrates a perspective view of an apparatus 10. In this view, the front surface 104 is shown, being partially covered by a band 106. Because the portion of the band 106 that is seen in this image is on the front surface 104, it will be referred to throughout as band top surface 112. It is understood, however, that the term band top surface, nor the term front surface, is not intended to be limiting, and either side of the apparatus 10 may be referred to as the "top" or "front."

Also seen in FIG. 1 is the frame 102 which surrounds the front surface 104. This frame includes a front wall 108, which creates a type of cavity in which cards, such as personal cards, credit cards, identification cards, etc., may reside. The front wall 108 may further include a recessed edge, which is shown in greater detail in FIG. 8.

The band 106 appears fairly tight to the front surface 104. As will be explored in FIG. 5, this is so that a card may be either tucked under the band 106 while still within the confines of the front wall 108, or placed over the band 106 to be secured in place by the recessed edge of the front wall 108, which, again, will be discussed further in FIG. 8.

The apparatus 10 as illustrated also includes a clip 110. The clip 110 may be a carabiner-type clip. This clip may be used for any desirable purposes, such as carrying keys or placing the apparatus 10 on a lanyard to be worn about a user's neck.

Figure 2:
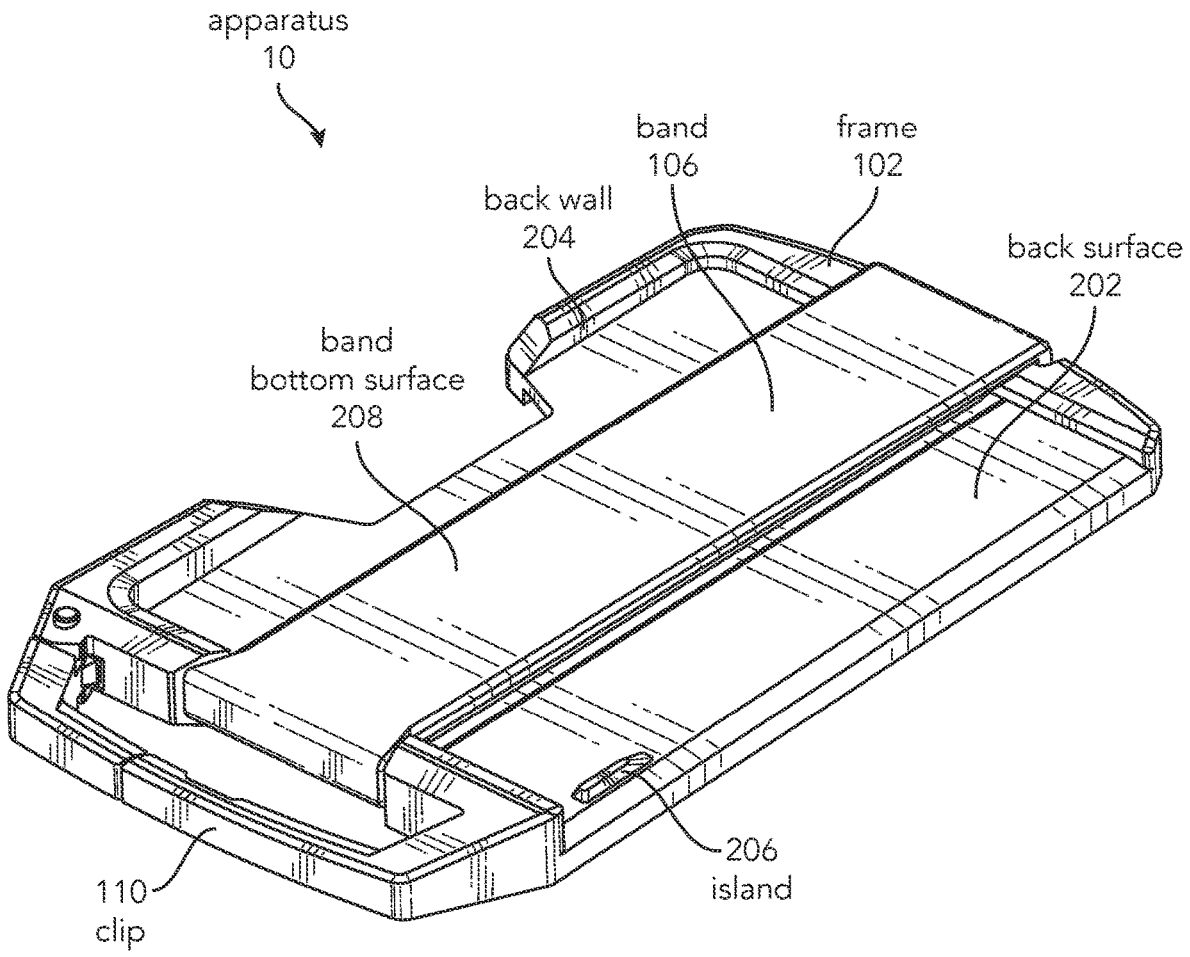
FIG. 2 illustrates a perspective view of the backside of the apparatus of FIG. 1, according to some examples.

FIG. 2 illustrates a perspective view of the backside of an apparatus 10, perhaps the apparatus 10 of FIG. 1. As shown in FIG. 2, the apparatus 10 includes a back surface 202. The frame 102 from the front surface 104 also protrudes from the back surface 202, forming a back wall 204, creating a cavity in which cards may reside on this back surface 202. The frame 102 includes a gap on this back surface 202 (which is shown and described in FIG. 4) into which cards may be slid. An island 206 may be present in this gap in order to prevent cards from slipping out of the cavity through this gap.

Also shown in FIG. 2 is the band bottom surface 208. As seen in FIG. 2, the band bottom surface 208 is further away from the back surface 202 than the band top surface 112 is from the front surface 104. This indicates that on the back surface 202, cards are intended to be placed and stored in place by the band 106.

Figure 3:
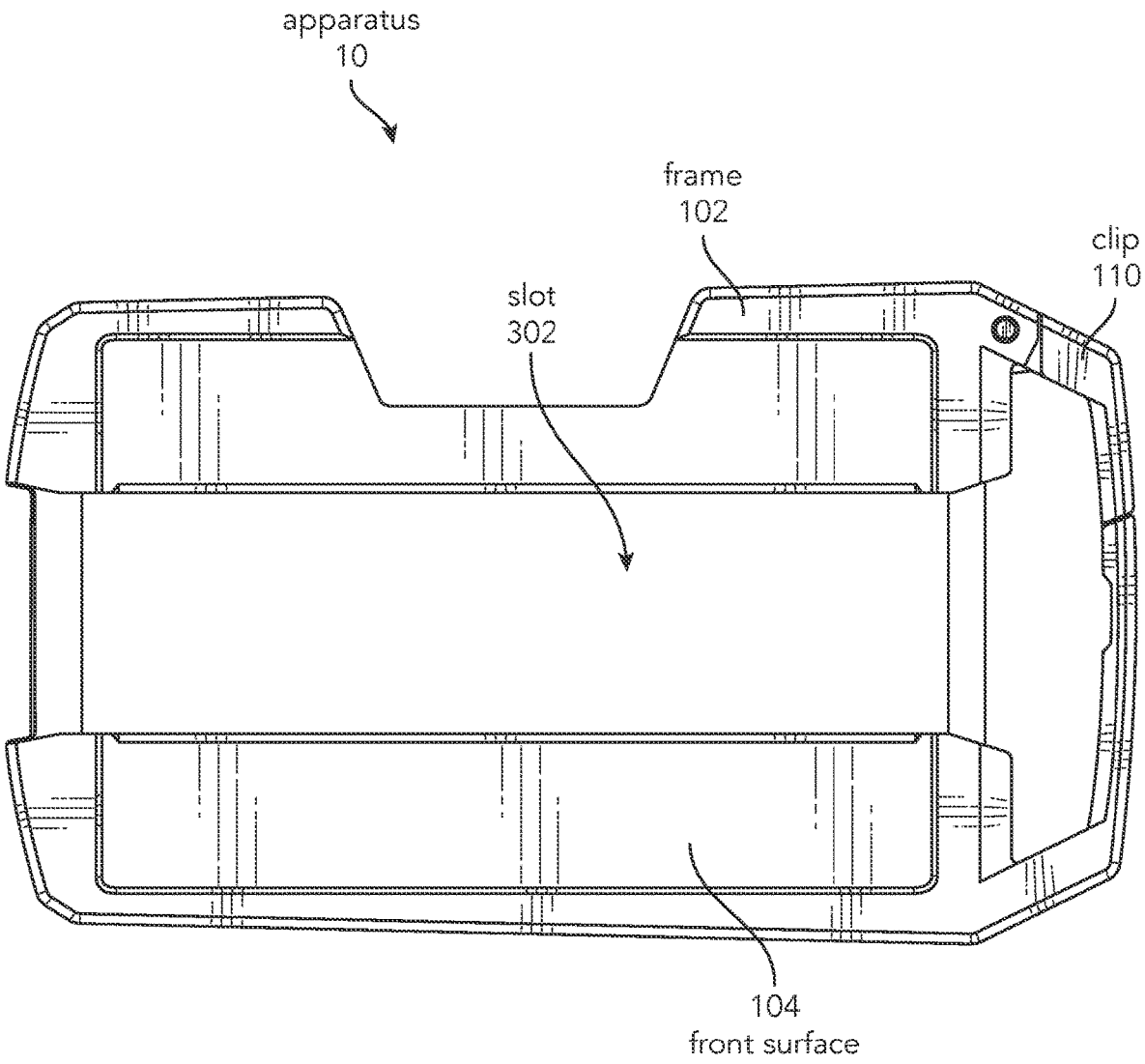
FIG. 3 illustrates a front view of an apparatus with a band removed, according to some examples.
Figure 7:
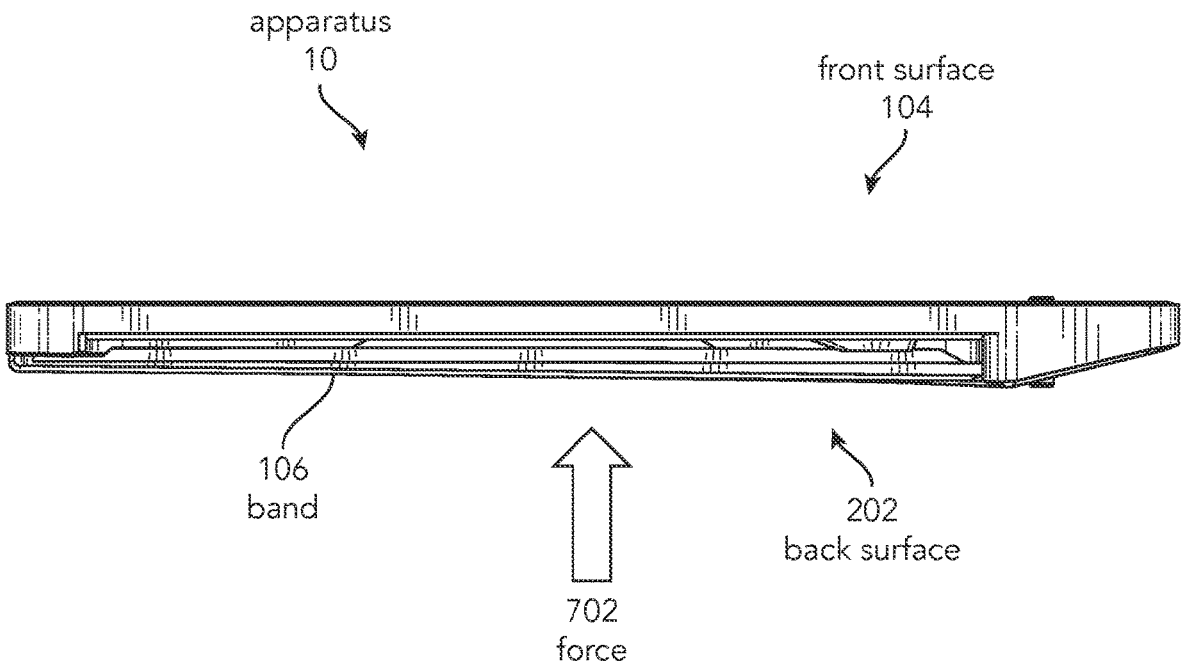
FIG. 7 illustrates a side view of the apparatus of FIG. 1, according to some examples.

FIG. 3 illustrates a front view of an apparatus 10 with the band 106 removed. In this view, the slot 302 may be seen. This slot 302 is an opening in the body of the apparatus 10 through which a force may be applied to any present cards (as seen in FIG. 7). The slot 302 is shown as extending across the entirety of the body of the apparatus 10 along what may be considered the major axis (greater length portion). This orientation and amount of coverage are also not strictly necessary, and it is understood that a slot 302 of any size and orientation that permits a force to be transmitted through the slot would be sufficient to enable the present disclosure.

Figure 4:
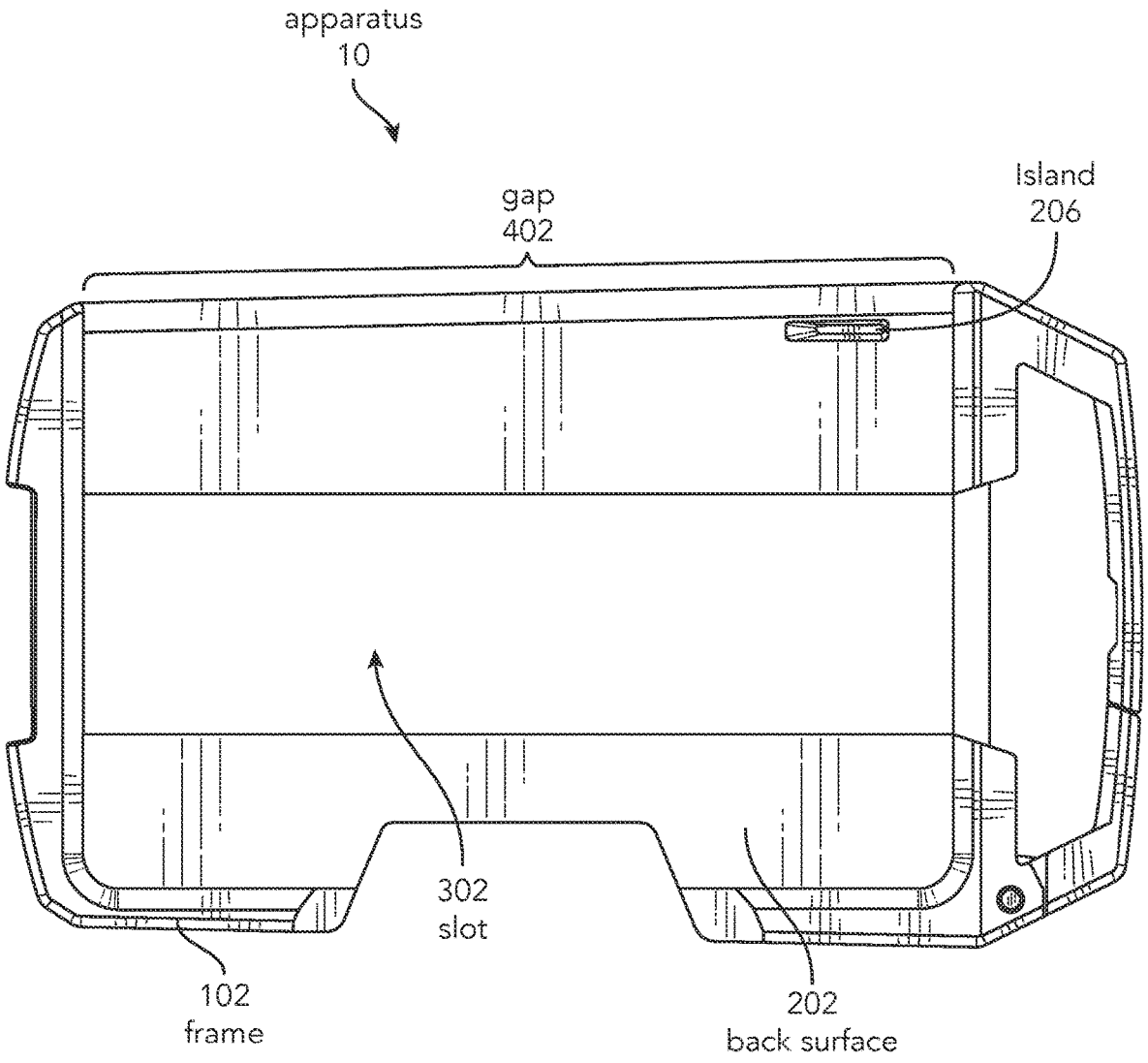
FIG. 4 illustrates a back view of the apparatus of FIG. 3, according to some examples.

FIG. 4 illustrates a back view of an apparatus 10 with the band 106 removed, perhaps the apparatus of FIG. 3. Because the slot 302 extends through the entirety of the body of the apparatus 10, it may be viewed from the back surface 202 in FIG. 4 as well. In this figure, the gap 402 in the frame 102 may be better viewed. This gap 402 extends across the entirety of this side of the frame 102, facilitating the sliding of cards the same length as the frame 102 to easily be slid into the formed cavity. It is understood that this gap 402 may be on any side of the back surface 202. It is also understood that the gap 402 and island 206 may be used in conjunction with the front surface 104, if desired.

To reiterate from FIG. 2, an island 206 may exist transverse to the back surface 202 near any portion of the gap 402 in the frame 102. The island 206 facilitates the prevention of incidental removal of any present cards by acting as a small portion of the frame while still permitting the gap 402 to function as an easy-access method of storing and retrieving the cards.

Figure 5:
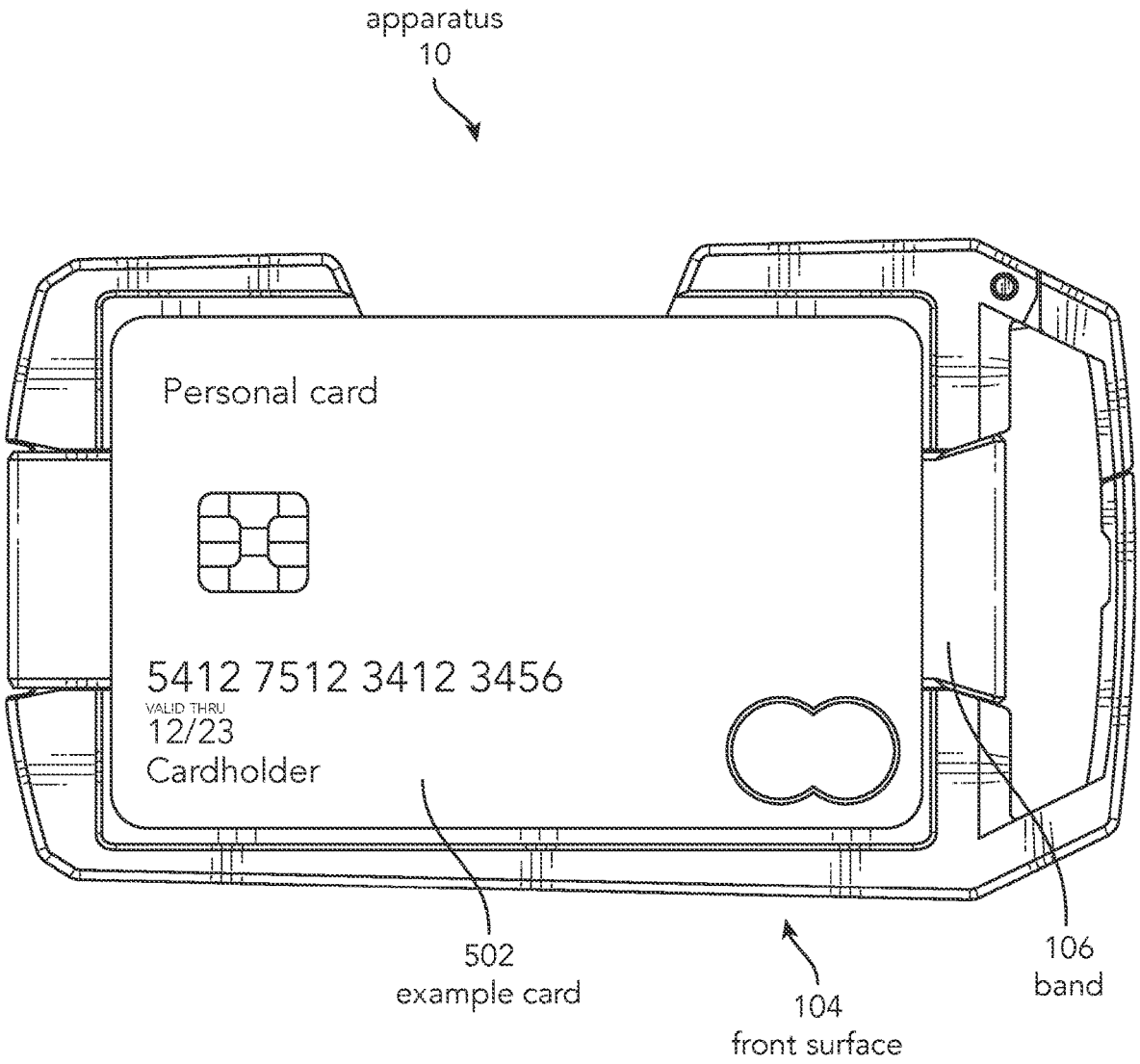
FIG. 5 illustrates a front view of the apparatus of FIG. 1 including a card, according to some examples.

FIG. 5 illustrates a front view of an apparatus 10 including an example card 502. For display purposes, a personal card (such as a credit card) is shown, but it is understood that any other card, such as an identification card, may be placed in the apparatus 10 under or over the band 106. As mentioned in FIG. 1, the band 106 may permit any present card to be either stored above or below the band 106. In FIG. 5, the card 502 is shown as being located above the band 106.

Figure 8:
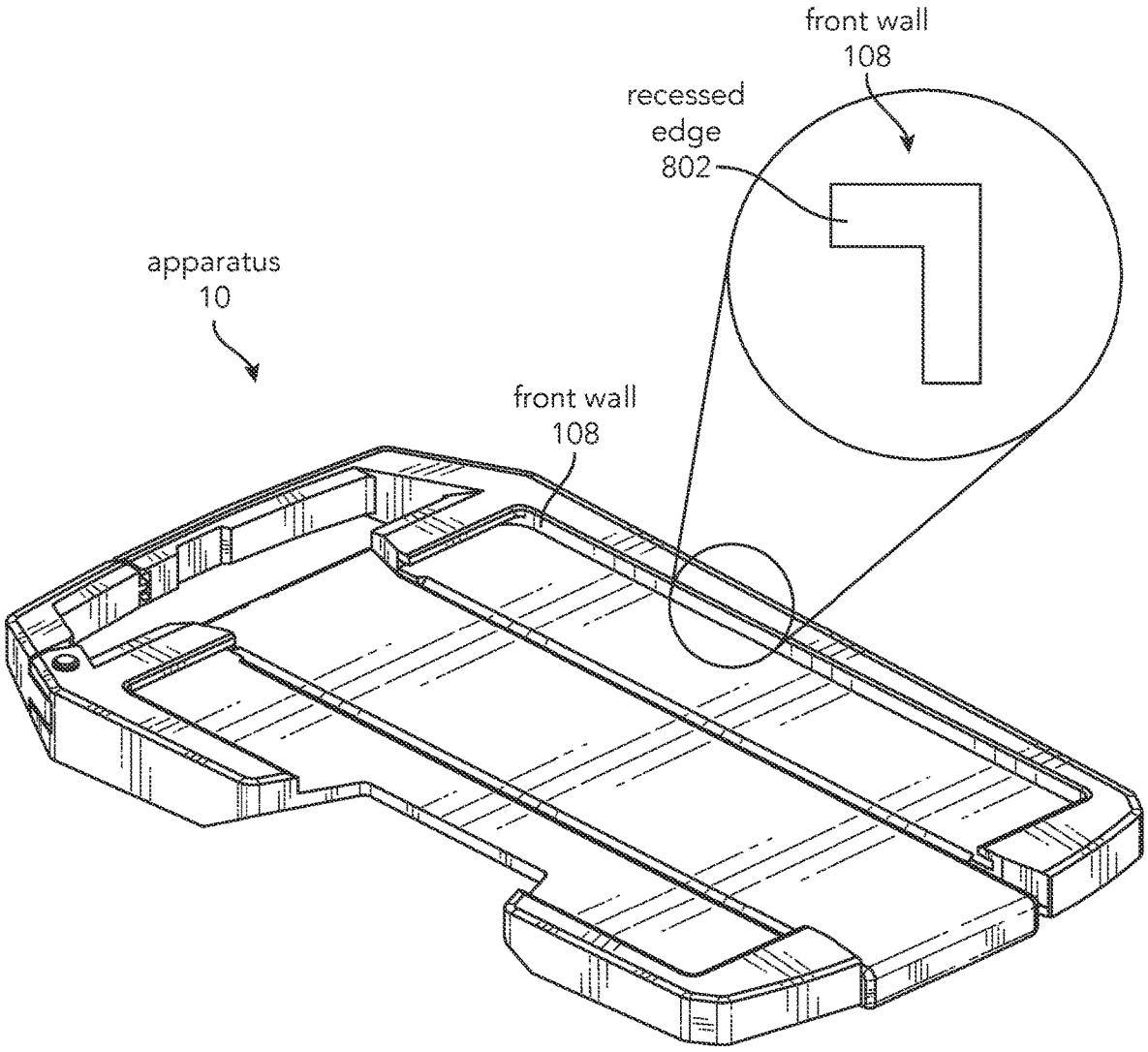
FIG. 8 illustrates a perspective view with an inset view of the apparatus of FIG. 1, according to some examples.

As will be shown in FIG. 8, recessed edges about the front wall 108 of the frame 102 may keep the card 502 in place while residing above the band 106. Additional cards that do not need to be readily accessed may be placed under the band 106 on this front surface 104 while still permitting card 502 to reside above the band 106 as shown, allowing card 502 to have quicker access than others. This may be useful in the case of a more consistently used credit card, or an identification card held on a lanyard to gain access to buildings which needs to be mostly exposed.

A combination of the frame 102 (perhaps with recessed walls as shown in FIG. 8) and the front surface 104 keep any present cards in place. In cases where the cards are placed under the band 106 along this front surface 104, a combination of the frame 102, the front surface 104, and the band 106 keeps any present cards in place.

Figure 6:
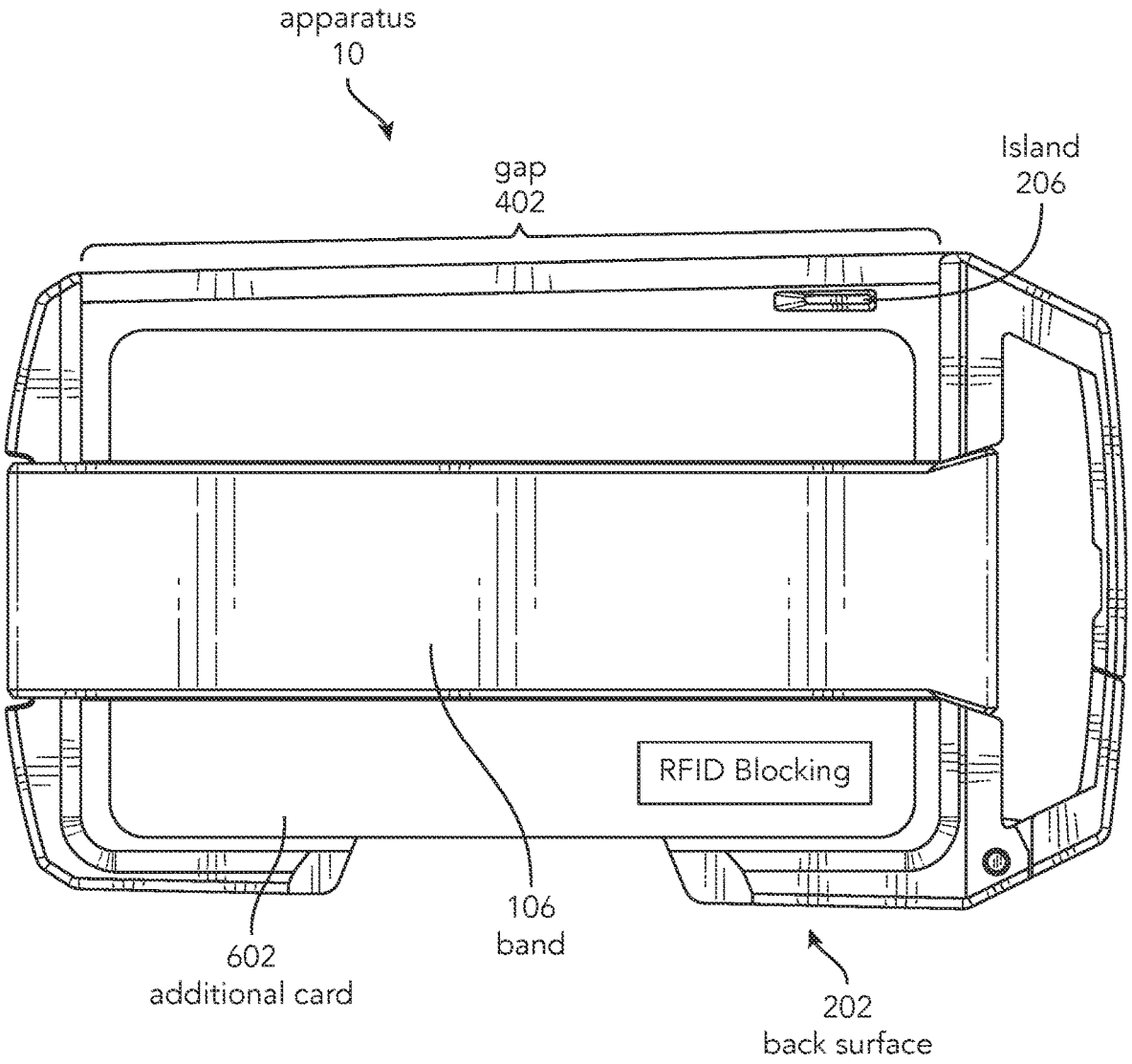
FIG. 6 illustrates a back view of the apparatus of FIG. 1 including a card, according to some examples.

FIG. 6 illustrates a back view of an apparatus 10 including an additional card 602. For display purposes, a radio frequency identification (RFID) card is shown, but it is understood that any other card, such as a credit card, may be placed in the apparatus 10 on this back surface 202 under the band 106. An RFID card is mentioned specifically as a feature that may prevent other cards on both the front surface 104 and back surface 202, from being read through the apparatus 10.

As mentioned in FIG. 2, the band bottom surface 208 is further away from the back surface 202 than the band top surface 112 is from the front surface 104. This indicates that on the back surface 202, cards are intended to be placed and stored in place by the band 106. Multiple cards may be placed under the band 106 to be held into place, along with other items, such as cash. A combination of the frame 102, island 206, back surface 202, and band 106 keeps any present cards secure in place.

FIG. 7 illustrates a side view of an apparatus 10 including a projected direction of force 702. When card 502 is placed on the front surface 104 but above the band 106, it may be tricky to retrieve card 502 from the front surface 104. This is one purpose of the slot 302.

In examples with or without the band 106, a force 702 may be applied from the back surface 202 through the slot 302 onto card 502 so that it may exit the front surface 104. In examples where a band 106 is present, the force 702 may be applied onto the band bottom surface 208 through the slot 302 onto the band top surface 112, transferring force 702 onto the card 502 so that it may exit the front surface 104.

FIG. 8 illustrates a perspective view with an inset view of an apparatus 10. The inset view illustrates a close-up, cross-sectional view of the front wall 108 of the frame 102. In this view, the recessed edge 802 that has been alluded to throughout this disclosure can be seen. It is understood that the recessed edge 802 as shown is exaggerated to express how it may work and that other geometries of recessed edge 802 may also enable the present disclosure.

As has been stated previously, if card 502 were to be kept along the front surface 104 while being above the band 106, the card 502 would only be secured from behind by the front surface 104 and from the sides by the frame 102. This would cause a potential risk of the card slipping out from the apparatus 10 in the direction opposite the front surface 104.

By using a recessed edge 802 along the front wall 108, the edges of the card 502 may be secured. This may permit the card 502 to be secured on all sides, while still permitting nearly unadulterated access to the card, which can be useful in the case of regularly needed cards such as identification cards.

The presence of a recessed edge 802, however, may make it more difficult for a user to retrieve the card 502 from the front surface. One such solution to this potential issue, as discussed in FIG. 7, is the ability to transfer a force 702 onto the backside of the card 502. This transfer of force 702 may occur through slot 302 directly onto the back of the card 502, thereby releasing the card 502 from the front surface 104. This transfer of force may also occur through the band 106 via application of force 702 onto the band bottom surface 208, which is then transferred to the band top surface 112, before being applied to the card 502.

Included in the present disclosure is an apparatus 10, including a frame 102 having a front surface 104 and a back surface 202. In some examples, the frame 102 is configured to hold card 502 at the front surface 104. According to some examples, the frame 102 is configured to release the card 502 via a force 702 from the back surface 202. The apparatus 10 may include a slot 302 configured to receive the force 702 from the back surface 202 during the release of the card 502.

In some examples, the apparatus 10 further includes a front wall 108 that is transverse to the front surface 104. According to some examples, the front wall 108 is configured to hold the card 502. The front wall 108 may include a recessed edge 802 configured to cover at least a portion of the card 502 when the card is held by the front surface 104.

In some examples, the apparatus 10 further includes a back wall 204 that is transverse to the back surface 202, wherein the back wall 204 is configured to hold the card 502. According to some examples, the apparatus 10 further includes a gap 402 formed by the back wall 204 and configured to receive the card 502. The apparatus 10 may further include an island 206 extending outward from the back surface 202 and located on a portion of a perimeter of the back surface 202 and configured to hold the card 502.

In some examples, the apparatus 10 further includes a band 106, the band 106 covering at least a portion of the frame 102 and configured to hold the card 502 to the back surface 202. According to some examples, the band 106 is closer to the front surface 104 than the back surface 202. The force 702 may be appliable on the band 106 along a portion of the band 106 covering the back surface 202 when the card 502 is released by the frame 102. In some examples, the front surface 104 is configured to hold the card 502 on a band top surface 112. According to some examples, the band 106 includes elastic material.

The apparatus 10 may further include a clip 110 coupled to a side of the frame 102. In some examples, the apparatus further includes an additional card 602 card attached to the back surface 202. According to some examples, the additional card 602 is removably attached to the back surface 202. The additional card 602 may be an RFID card.

Also included in the present disclosure is an apparatus 10, including a frame 102 having a front surface 104 and a back surface 202. In some examples, the frame 102 is configured to hold card 502 at the front surface 104. According to some examples, the frame 102 is configured to release the card 502 via a force 702 from the back surface 202. The apparatus 10 may include a band 106, the band 106 covering at least a portion of the frame 102. In some examples, the band 106 is configured to transfer the force 702 from the back surface 202 to the card 502 during the release of the card 502. According to some examples, the band 106 is configured to hold an additional card at the back surface 202.

The frame 102 may include a slot 302 at least partially covered by the band 106 through which the force 702 is appliable to detach the card 502. In some examples, the apparatus 10 further includes a front wall 108 that is transverse to the front surface 104. According to some examples, the front wall 108 is configured to hold the card 502. The front wall 108 may include a recessed edge 802 configured to cover at least a portion of the card 502 when the card is held by the front surface 104.

In some examples, the apparatus 10 further includes a back wall 204 that is transverse to the back surface 202, wherein the back wall 204 is configured to hold the card 502. According to some examples, the apparatus 10 further includes a gap 402 formed by the back wall 204 and configured to receive the card 502. The apparatus 10 may further include an island 206 extending outward from the back surface 202 and located on a portion of a perimeter of the back surface 202 and configured to hold the card 502.

In some examples, the apparatus 10 further includes a clip 110 coupled to a side of the frame 102. According to some examples, the apparatus 10 further includes an additional card 602 attached to the back surface 202. The additional card 602 may be removably attached to the back surface 202. In some examples, the additional card 602 is attached to the back surface 202 via the band 106. According to some examples, the additional card 602 is held between the back surface 202 and a band bottom surface 208. In some examples, the additional card 602 is an RFID card.

The band 106 may be closer to the front surface 104 than the back surface 202. In some examples, the band 106 includes elastic material. According to some examples, the front surface 104 is configured to hold the card 502 on a band top surface 112.

Also included in the present disclosure is an apparatus 10, including a frame 102 having a front surface 104 and a back surface 202. In some examples, the frame 102 is configured to hold card 502 at the front surface 104. According to some examples, the frame 102 is configured to release the card 502 via a force 702 from the back surface 202. The apparatus 10 may include a slot 302 configured to receive the force 702 from the back surface 202 during the release of the card 502. In some examples, the apparatus 10 includes a band 106, the band 106 covering at least a portion of the frame 102 and at least partially covering the slot 302. According to some examples, the band 106 is configured to transfer the force 702 from the back surface 202 to the card 502 during the release of the card 502. The band 106 may be configured to hold an additional card at the back surface 202.

In some examples, the apparatus 10 further includes a front wall 108 that is transverse to the front surface 104. According to some examples, the front wall 108 is configured to hold the card 502. The front wall 108 may include a recessed edge 802 configured to cover at least a portion of the card 502 when the card is held by the front surface 104.

In some examples, the apparatus 10 further includes a back wall 204 that is transverse to the back surface 202, wherein the back wall 204 is configured to hold the card 502. According to some examples, the apparatus 10 further includes a gap 402 formed by the back wall 204 and configured to receive the card 502. The apparatus 10 may further include an island 206 extending outward from the back surface 202 and located on a portion of a perimeter of the back surface 202 and configured to hold the card 502.

In some examples, the apparatus 10 further includes a clip 110 coupled to a side of the frame 102. According to some examples, the apparatus 10 further includes an additional card 602 attached to the back surface 202. The additional card 602 may be removably attached to the back surface 202. In some examples, the additional card 602 is attached to the back surface 202 via the band 106. According to some examples, the additional card 602 is held between the back surface 202 and a band bottom surface 208. In some examples, the additional card 602 is an RFID card.

The band 106 may be closer to the front surface 104 than the back surface 202. In some examples, the band 106 includes elastic material. According to some examples, the front surface 104 is configured to hold the card 502 on a band top surface 112.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might,""may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

We claim:

1. An apparatus, comprising:

a frame comprising a front surface and a back surface, the frame configured to:

hold a card at the front surface, and release the card via a force from the back surface;

a slot configured to receive the force from the back surface during the release of the card; and an island extending outward from the back surface and located on a portion of a perimeter of the back surface and configured to prevent movement of the card in a direction of the island.

2. The apparatus of claim 1, further comprising a front wall that is transverse to the front surface.

3. The apparatus of claim 2, wherein the front wall is configured to hold the card.

4. The apparatus of claim 2, wherein the front wall comprises a recessed edge configured to cover at least a portion of the card when the card is held by the front surface.

5. The apparatus of claim 1, further comprising a back wall that is transverse to the back surface, wherein the back wall is configured to hold the card.

6. The apparatus of claim 5, further comprising a gap formed by the back wall and configured to receive the card.

7. The apparatus of claim 1, further comprising a band, the band covering at least a portion of the frame and configured to hold the card to the back surface.

8. The apparatus of claim 1, further comprising a clip coupled to a side of the frame.

9. The apparatus of claim 1, further comprising a radio frequency identification (RFID) card attached to the back surface.

10. An apparatus, comprising:

a frame comprising a front surface and a back surface, the frame configured to:

hold a card at the front surface, and release the card via a force from the back surface; and a band, the band covering at least a portion of the front surface and at least a portion of the back surface, the band configured to:

transfer the force from the back surface to the card during the release of the card, and hold an additional card at the back surface.

11. The apparatus of claim 10, wherein the frame comprises a slot at least partially covered by the band through which the force is appliable to detach the card.

12. The apparatus of claim 10, further comprising an additional card attached to the back surface.

13. The apparatus of claim 12, wherein the additional card is removably attached to the back surface.

14. The apparatus of claim 12, wherein the additional card is attached to the back surface via the band.

15. The apparatus of claim 14, wherein the additional card is held between the back surface and a band bottom surface.

16. The apparatus of claim 10, wherein the band is closer to the front surface than the back surface.

17. The apparatus of claim 10, wherein the band comprises elastic material.

18. The apparatus of claim 10, wherein the front surface is configured to hold the card on a band top surface.

19. The apparatus of claim 10, wherein the frame is configured to hold the card exterior to the band.

20. An apparatus, comprising:

a frame comprising a front surface and a back surface, the frame configured to:

hold a card at the front surface, and release the card via a force from the back surface;

a slot configured to receive the force from the back surface during the release of the card; and a band, the band covering at least a portion of the front surface and at least a portion of the back surface, the band at least partially covering the slot, the band configured to:

transfer the force from the back surface to the card during the release of the card, and hold an additional card at the back surface.

* * * * *